US012234995B2

(12) United States Patent
Cowan

(10) Patent No.: US 12,234,995 B2
(45) Date of Patent: Feb. 25, 2025

(54) ON DEMAND OVEN DOOR LOCK

(71) Applicant: Midea Group Co., Ltd., Foshan (CN)

(72) Inventor: Richard W. Cowan, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 338 days.

(21) Appl. No.: 17/853,164

(22) Filed: Jun. 29, 2022

(65) Prior Publication Data

US 2024/0003550 A1 Jan. 4, 2024

(51) Int. Cl.
*F24C 15/02* (2006.01)
*A47J 36/12* (2006.01)
*F24C 15/36* (2006.01)

(52) U.S. Cl.
CPC ..... *F24C 15/36* (2013.01); *F24C 15/022* (2013.01)

(58) Field of Classification Search
CPC ..... F24C 7/085; F24C 15/022; F24C 15/02; F24C 15/162; A21B 1/00; A47J 36/12
See application file for complete search history.

(56) References Cited

U.S. PATENT DOCUMENTS 4,345,144 A * 8/1982 Bergquist ..... F24C 15/022 219/398
7,040,674 B2 5/2006 Lomicka et al.
7,728,711 B2 6/2010 Shoenfeld
8,327,835 B2 12/2012 Larsen et al.
8,514,084 B2 8/2013 Yi
8,800,544 B2 * 8/2014 Newsom ..... F24C 15/022 126/192
9,161,650 B2 * 10/2015 Wood ..... A47J 27/0817
9,396,599 B1 7/2016 Malhorta
9,677,771 B2 * 6/2017 Armstrong ..... H04L 67/51
9,754,432 B2 9/2017 Bender et al.
10,084,783 B2 9/2018 Dubman et al.
10,482,756 B2 11/2019 Kumar et al.
10,825,311 B2 * 11/2020 Taylor ..... G07C 9/28
10,829,959 B2 * 11/2020 Lowder ..... H05K 7/1418
2005/0284460 A1 12/2005 Fitzsimons et al.
2016/0076776 A1 3/2016 Gardner et al.
(Continued)

FOREIGN PATENT DOCUMENTS

CN 208388192 U * 1/2019
DE 112011104388 T5 * 9/2013 ..... A47J 27/04
(Continued)

OTHER PUBLICATIONS

Patil et al., Internet of Things Based Integrated Smart Home Automation System, SSRN Electronic Journal; International Conference on Communication and Information Processing, www.researchgate.net/publication/342863089, 10 pages, dated Jan. 2020.
(Continued)

*Primary Examiner* — Gregory A Wilson
(74) *Attorney, Agent, or Firm* — Gray Ice Higdon

(57) ABSTRACT

A cooking apparatus includes a control circuit configured to operate an electronic lock on demand in response to user input provided to a user interface. The electronic lock may be operable regardless of whether the oven is active, and cooking operations may be started, stopped or modified even when the electronic lock is engaged.

20 Claims, 3 Drawing Sheets

(56) References Cited

U.S. PATENT DOCUMENTS

| | | | | |
|---|---|---|---|---|
| 2018/0095439 | A1 | 4/2018 | Karbasian et al. | |
| 2024/0003550 | A1 * | 1/2024 | Cowan | F24C 7/085 |

FOREIGN PATENT DOCUMENTS

| | | | | | |
|---|---|---|---|---|---|
| DE | 102017111166 | A1 * | 11/2018 | ..... | E05B 17/0029 |
| EP | 3112757 | A1 * | 1/2017 | ..... | F24C 7/082 |
| EP | 2885679 | B1 * | 7/2021 | ..... | E05B 45/06 |
| WO | WO-2010070399 | A2 * | 6/2010 | ..... | D06F 37/42 |

OTHER PUBLICATIONS

Jabbar et al., Design and Fabrication of Smart Home with Internet of Things Enabled Automation System, IEEE Access, 16 pages, dated 2017.
Related Applications Transmittal dated Jun. 29, 2022.

* cited by examiner

ON DEMAND OVEN DOOR LOCK

BACKGROUND

Cooking appliances such as ovens, ranges, cooktops, etc. are typically located in a kitchen in locations that are accessible to all individuals in a residence. Ranges, for example, may include both an oven and a cooktop. A cooktop is generally located on the top surface of the range housing and is accessible to anyone of the requisite height to reach the cooking elements and controls. An oven generally includes an oven cavity that is disposed within the range housing and that is typically accessible via a door that provides external access to the oven cavity.

An oven door is generally pivotable about a bottom hinge and is frequently located on the face of the cooking appliance that will be most frequently viewed by users and is operable by anyone of the requisite ability to move the door. The oven cavity is typically accessible at all times by opening the door. The door may be movable from a closed position to an open position, or an open position to a closed position.

It has been found that due to both the height and the bottom hinged configuration of an oven door, it may be possible for young children or even pets to open an oven door in some circumstances, even if the oven is currently on and the oven cavity is at a cooking temperature. While some oven units include manufacturer locks for locking oven doors, these locks are generally only available in conjunction with a self-cleaning mode. While some aftermarket locks are commercially available for locking oven doors, such locks are generally unsightly and cumbersome to use, and are only useful when a user remembers to activate the lock.

SUMMARY

The herein-described embodiments address these and other problems associated with the art by providing an on demand electronic oven door lock capable of being locked or unlocked regardless of whether the oven is currently active. In addition, oven cooking operations may be started and/or stopped, and in some instances, modified, even when the electronic lock is engaged.

Therefore, consistent with one aspect of the invention, a cooking apparatus, may include a housing, an oven cavity disposed within the housing, one or more cooking elements configured to heat the oven cavity, a door coupled to the housing, where the door is movable from a closed position to an open position to provide external access to the oven cavity, an electronic lock configured to selectively lock the door in the closed position, a user interface configured to receive user input, and a control circuit coupled to the electronic lock and the user interface. The control circuit may be configured to process on demand lock user input received by the user interface to engage or disengage the electronic lock on demand and to engage or disengage the electronic lock in response to the on demand lock user input. The control circuit may be further configured to engage or disengage the electronic lock in response to the on demand lock user input irrespective of whether the oven is currently active. The control circuit may be further configured to start and/or stop an oven cooking operation in response to cooking user input received while the electronic lock is engaged.

In some embodiments, the cooking apparatus may further include a cooktop. The control circuit may be configured to engage or disengage the electronic lock in response to the on demand lock user input irrespective of whether the cooktop is currently active. The control circuit may be further configured to start and/or stop a cooktop cooking operation in response to cooking user input while the electronic lock is engaged.

In some embodiments, an actuator of the electronic lock is inaccessible to the user. Further, in some embodiments, the on demand lock user input includes simultaneous activation of multiple user controls of the user interface. In some embodiments, the on demand lock user input includes activation of a user control of the user interface for a preset amount of time. In addition, in some embodiments, the control circuit is further configured to generate an alert after engaging or disengaging the electronic lock.

In some embodiments, the control circuit is further configured to modify the oven cooking operation in response to cooking user input received while the electronic lock is engaged. In addition, in some embodiments, the cooking user input that modifies the oven cooking operation switches a cooking mode used for the oven cooking operation. In some embodiments, the cooking user input that modifies the oven cooking operation increases or decreases a temperature setpoint. Further, in some embodiments, a second oven cooking operation is started, modified, or stopped in response to the electronic lock engaging.

Consistent with another aspect of the invention, a method may be provided for operating a cooking apparatus of a type including a housing, an oven cavity disposed within the housing, one or more cooking elements configured to heat the oven cavity, a door coupled to the housing and movable from a closed position to an open position to provide external access to the oven cavity, an electronic lock configured to selectively lock the door in the closed position, a user interface configured to receive user input, and a control circuit. The method may include receiving, from the user interface, first on demand lock user input to engage or disengage the electronic lock on demand while the oven is active, selectively engaging or disengaging the electronic lock with the control circuit in response to the first on demand lock user input and while the oven is active, receiving, from the user interface, second on demand lock user input to engage or disengage the electronic lock on demand while the oven is inactive, selectively engaging or disengaging the electronic lock with the control circuit in response to the second on demand lock user input and while the oven is inactive, receiving, from the user interface and while the electronic lock is engaged, cooking user input to start or stop an oven cooking operation, and starting or stopping the oven cooking operation with the control circuit while the electronic lock is engaged in response to the cooking user input.

In some embodiments, the method may further include determining, in response to receiving, from the user interface, the first on demand lock user input to engage or disengage the electronic lock on demand, whether the electronic lock has a delay, and in response to determining a delay exists, waiting the amount of time for the delay to expire before operating the electronic lock. In some embodiments, the method may further include determining, in response to selectively engaging or disengaging the electronic lock with the control circuit in response to the first on demand lock user input, whether to adjust the oven settings, and in response to determining to adjust the oven settings, adjusting the oven settings.

In some embodiments, the method may further include determining, in response to selectively engaging or disengaging the electronic lock, whether an alert should be generated, and in response to determining that the alert should be generated, generating the alert. In some embodiments, the first on demand lock user input is a simultaneous activation of multiple user controls of the user interface, while in some embodiments, the first on demand lock user input is an activation of a user control of the user interface for a preset amount of time.

In some embodiments, the method may further include modifying, in response to receiving second cooking user input to modify the oven cooking operation, the oven cooking operation while the electronic lock is engaged. In some embodiments, the second cooking user input switches a cooking mode used for the oven cooking operation, and in some embodiments, the second cooking user input increases or decreases a temperature setpoint. In some embodiments, the method may further include starting, modifying, or stopping, in response to selectively engaging or disengaging the electronic lock, a second oven cooking operation.

These and other advantages and features, which characterize the invention, are set forth in the claims annexed hereto. For a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
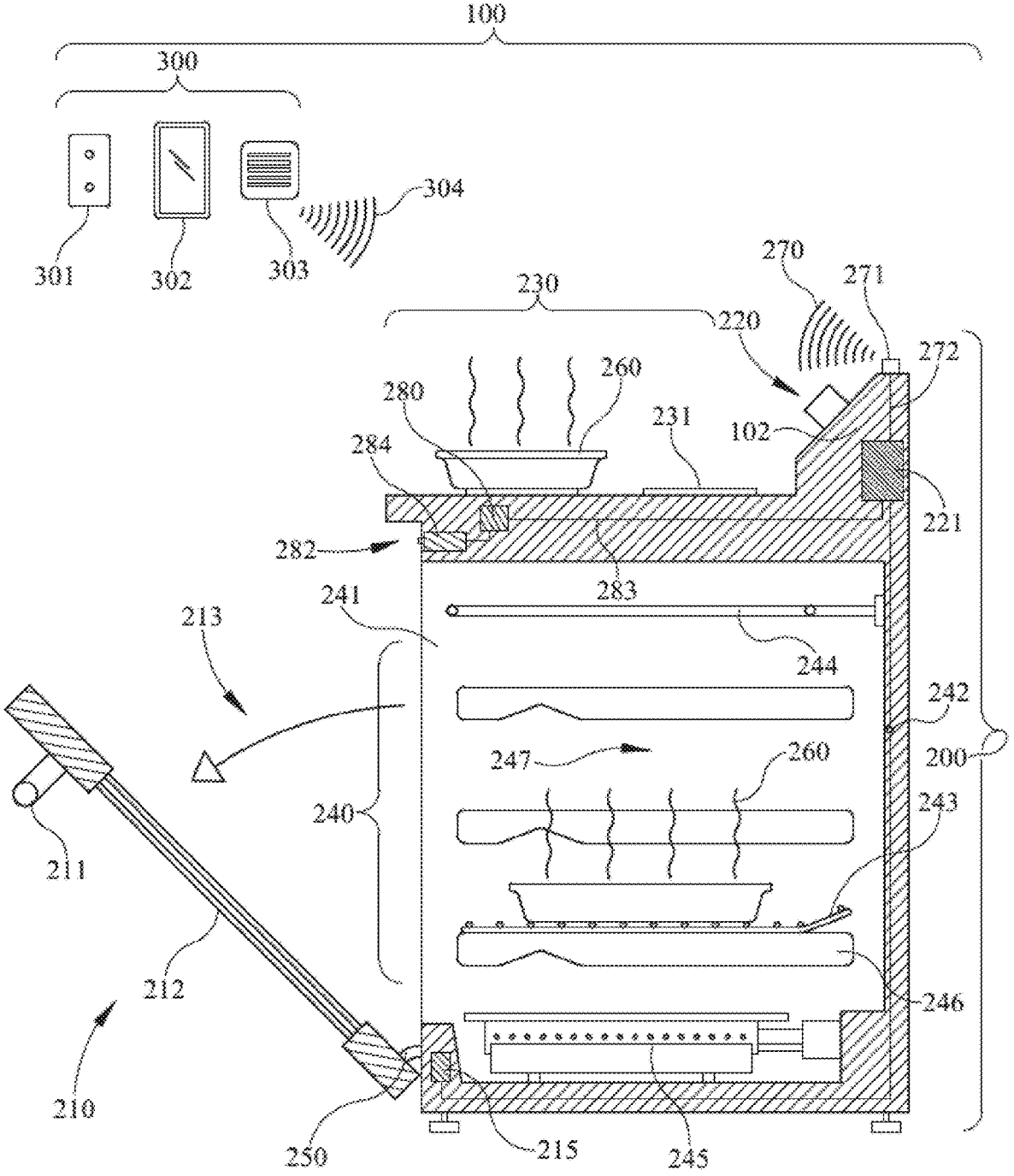
FIG. 1 is a cross sectional view of a cooking apparatus consistent with some embodiments of the invention, and with the door open.

A cooking apparatus consistent with the invention includes an on demand electronic oven door lock for selectively locking an oven door in a closed position. As will become more apparent below, a user may provide input to operate (engage or disengage) the lock on demand, and in many instances, regardless of the cooking state of the cooking apparatus. Moreover, as will also become more apparent below, activation of the on demand electronic oven door lock in many instances will generally not inhibit other operations, such as oven and/or cooking operations, to be started, stopped and/or modified while the oven door lock is engaged.

In this regard, an "on demand" electronic oven door lock may be considered to refer to an electronic oven door lock that is capable of being engaged or disengaged regardless of whether or not the oven is currently active, e.g., regardless of whether or not a cooking operation is currently being performed in the oven, and regardless of whether or not the oven cooking elements are active and/or whether the oven cavity is currently at an elevated temperature. Furthermore, an on demand electronic oven door lock as described herein generally does not restrict user operation of the oven, or if the cooking apparatus is a range, a cooktop, while the electronic oven door lock is engaged and movement of the oven door from the closed position is prevented. In many instances, the state of the electronic oven door lock is effectively independent of the current cooking or operational state of the oven.

The embodiments discussed hereinafter are directed in part to a cooking apparatus with a control circuit configured to operate (i.e. engage or disengage) an electronic oven door lock and thereby prevent or enable oven door movement away from a closed position in response to on demand lock user input, and generally without regard to whether or not the oven is currently active. In some embodiments, the electronic lock may be implemented using various types of electronic locks (including electrically-actuated, magnetically-actuated, and electromechanically-actuated locks), and in some instances, a user may still be able to start, stop and/or modify oven cooking operations even when the electronic lock is engaged.

In some embodiments, some or all of the components used by the control circuit to operate the lock may integrated into a cooking apparatus. In some embodiments, some or all of the components used by the control circuit to operate the lock may be distinct from a cooking apparatus and may be provided, for example, as an aftermarket addition, yet may still be considered to be integrated into the cooking apparatus once installed.

In some embodiments, a control circuit may be configured to operate the lock irrespective of whether the oven is powered on or powered off, i.e., whether or not the cooking element(s) of the oven are currently activated. In some embodiments, however, operation of the lock may also be temperature dependent, e.g., based upon an oven cavity reaching a higher temperature as a result of a self-cleaning operation or an extended broil cooking operation, such that, for example, the lock is automatically engaged whenever the oven cavity temperature exceeds a predetermined threshold (e.g., about 600 degrees Fahrenheit), and is thereafter prohibited from being disengaged until the oven cavity temperature drops below this threshold. In some embodiments, at least an actuator of the lock is disposed in the interior of the oven housing and is inaccessible to the user, even when disengaged. In some embodiments, such as a magnetic lock, the lock is disposed in the interior of the oven housing and is inaccessible to the user when engaged or disengaged. In other embodiments, the lock is attached to the oven housing or interior in a way to be inaccessible to the user regardless of the lock's state of operation, e.g., with an electronic lock actuator that is disposed within the oven housing or interior.

In some embodiments, operation of the lock by the control circuit may be performed using the control circuit, and a user interface. However, for cost effectiveness, other embodiments may include fewer or additional components. In addition, while the control circuit may incorporate a controller, processor, microcontroller, or other programmable component capable of executing instructions, and thus implementing at least a portion of the functionality discussed herein in software, in other embodiments a control circuit may include only fixed logic, e.g., implemented with passive and/or active components. Further, the control circuit's operation of the lock may or may not modify the cooking state of the apparatus when engaged or disengaged.

In order to determine when a user would like the lock to be operated, a user interface may be included to receive user input. The control circuit may be configured to operate the lock in response to specific user input referred to herein as on demand lock user input, and thus may be considered to be any user input that is directed to either engaging or disengaging the on demand electronic oven door lock. In some instances, a user may need to provide input to two or more controls of the user interface to satisfy the on demand lock user input. In some instances, a user may need to provide input for a preset period of time to satisfy the on demand lock user input. In some instances, the on demand lock user input may be from a remote device, such as an automated assistant or mobile phone. In some instances, however, it may also be desirable to restrict lock engagement to situations where a user is in the vicinity of the oven, e.g., by requiring user input directly to the cooking apparatus, to enable a user to verify the contents and state of the oven prior to lock engagement. In such instances, however, remote lock disengagement may still be allowed without additional user input to the cooking apparatus. the on demand lock user input may be from a remote device, such as an automated assistant or mobile phone, but also require a human user input. In other instances, no remote lock engagement or disengagement may be supported. In some instances, if on demand lock user input provided directly to the user interface is provided and on demand lock user input from a remote device is provided, the user input from the remote device may be ignored, and the direct user input may be used to satisfy the on demand lock user input.

In some embodiments a user interface may be configured to receive other user inputs in addition to, or instead of, those relating to door lock operation. These other inputs can relate to traditional oven functions, such as cooking, and may be referred to herein as cooking user inputs, which may include, for example, cooking mode selection controls, cooking temperature selection controls, cooking time selection controls, cooking delay selection controls, cooking start and/or stop controls, or practically any user control that may be used to start, stop or modify a cooking operation performed in the oven. The user interface used for determining input may use any means, such as buttons, knobs, touchscreens, etc. (among others) to determine whether the user input has been generated by a user, and what the function of that user input is. In some embodiments, the on demand lock user input includes activation of a user control (wherein the user control is a component of the user interface) of the user interface for a preset amount of time, simultaneous activation of multiple user controls, or other types of inputs that to some extent distinguish from inadvertent user inputs that could potentially be received, for example, from a child playing with the oven and randomly engaging different controls. Other types of user interfaces will be appreciated by those of ordinary skill having the benefit of the instant disclosure.

The control circuit may be configured to execute one or more functions relating to the operation of the lock. One function of the one or more functions may be to operate (i.e. engage or disengage) the lock. When a user input indicates that the lock should be engaged, the control circuit may be configured to engage the lock to prevent movement of the door. When a user input indicates that the lock should be disengaged, the control circuit may be configured to disengage the lock to permit movement of the door. The control circuit may be configured to engage or disengage the lock regardless of the cooking state of the oven. Moreover, the control circuit may be configured to start, stop and/or modify a cooking operation regardless of the state of the lock. The control circuit may be configured to also control one or more other functions, such as incorporating a delay with regards to the operation of the lock after receiving user input, transmitting data relating to the lock operation to an output device, and any other functions that may be useful to the user.

The control circuit may also be configured to generate an alert in response to the operation of the lock. The alert may be presented in a number of different ways. Some means of conveying an alert may include visual displays, audio speakers, haptic output motors, and any other means of conveying a signal to a user. As such, the control circuit's generation of the alert may include at least one or more of audio cues, visual cues, and haptic cues, and any other means of conveying a notification.

In some embodiments, the control circuit may be configured to include a delay associated with the operation of the lock. In some embodiments, the delay is incorporated in the time between the control circuit determining user input indicating operation of the lock and operation of the lock, and in some embodiments, the delay may only be usable for lock disengagement. This delay may be configured to operate for a preset period of time.

In other embodiments, the control circuit operates the lock regardless of whether the cooking apparatus is powered on or off. In other embodiments the control circuit is configurable to operate the lock only if the oven door is closed or open.

In some embodiments, the control circuit generates an alert by communicating an electronic message in response to operation of the lock, and the alert is received by remote devices. This receipt of the alert by the remote devices may be through wireless or wired connection. This receipt may be received by remote devices, such as automated assistants, phones, or fire alarms. A device may respond to the cooking apparatus. The response by the device may cause one or more functions to be executed by the control circuit, e.g., in response to a command issued by the device to the cooking apparatus. The execution of these functions by the control circuit may serve to adjust the temperature or alert settings on the oven, among other possible functions.

Other features and modifications will be appreciated by those of ordinary skill having the benefit of the instant disclosure.

Figure 2:
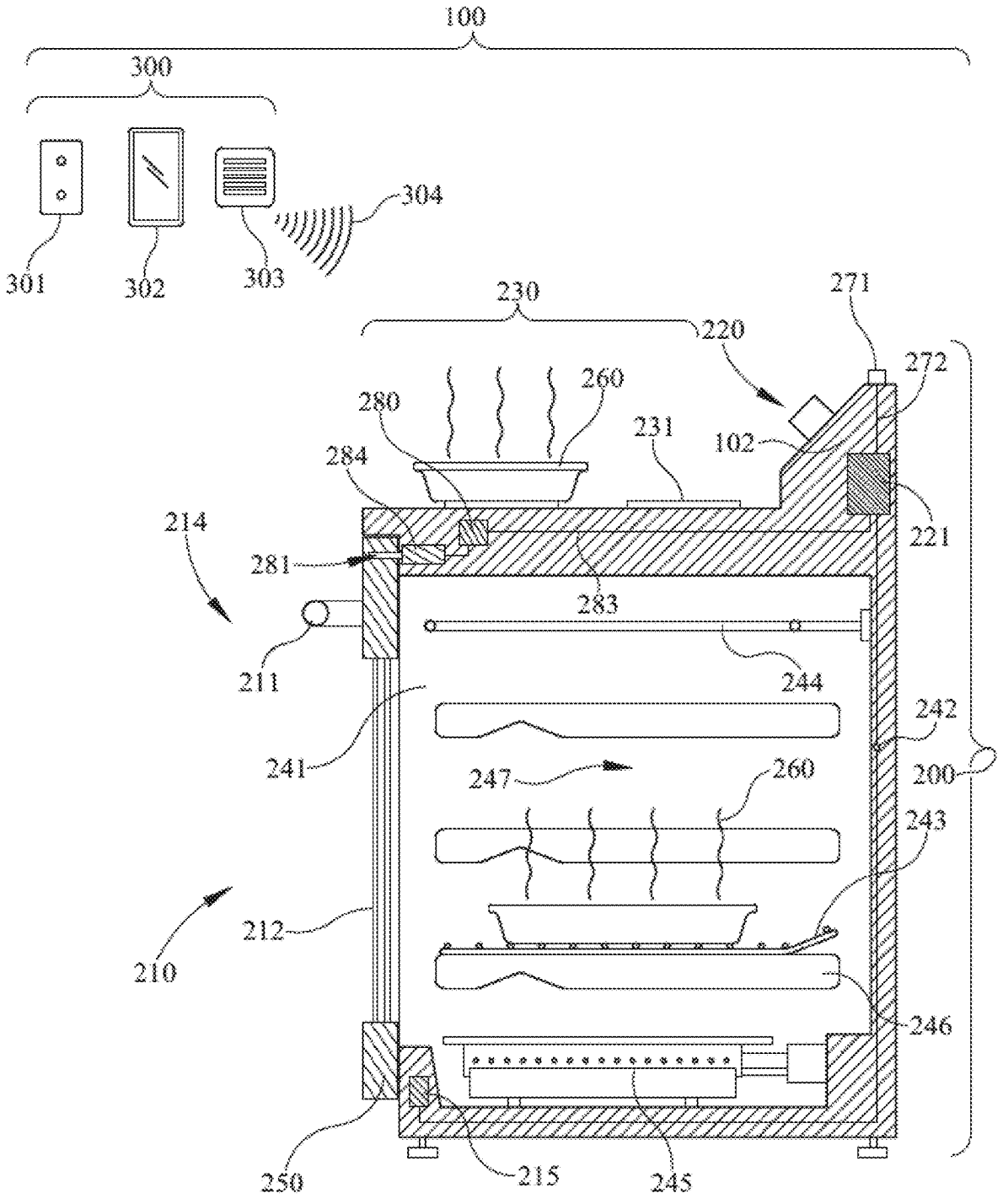
FIG. 2 is a cross sectional view of the cooking apparatus of FIG. 1 with the door closed.

Turning now to the drawings, wherein like numbers denote like parts throughout the several views, the overall configuration of a cooking apparatus within which the herein-described alert functionality may be utilized is shown in FIGS. 1-2. An appliance area 100 may include a cooking apparatus 200 that includes a door 210, a door handle 211, and a front panel 212. The door may be movable between an open position 213 (e.g., as shown in FIG. 1) and a closed position 214 (FIG. 2).

In the embodiment shown, the cooking apparatus 200 includes a user interface 220 and a control circuit 221 that drives the user interface. The user interface 220 may be electronic and may be used to both convey information to a user as well as receive user input from a user to operate the cooking apparatus. The user interface 220 may include controls, knobs, buttons, touchscreens, and any other apparatus capable of receiving user input. The control circuit 221, in response to user input received from the user interface 220 may be used to control a cooktop 230, including one or more cooking elements 231. Cooking utensils may also be located on one or more of the cooking elements 231. The user interface 220 may also be used to control an oven 240 of the cooking apparatus 200.

The oven 240 of the cooking apparatus 200 contains several elements in the illustrated embodiment, including one or more walls 241, a temperature sensor 242, one or more baking racks 243, a top heating element 244, a bottom heating element 245, and rails 246 for supporting the baking rack(s) 243. The oven 240 of the cooking apparatus 200 defines an oven cavity 247 that, during operation, is maintained at an elevated temperature through activation of one or both of heating elements 244, 245. Door 210 provides external access to oven cavity 247, and as illustrated is supported by a door hinge 250 that allows the door to pivot about a pivot point defined by a substantially horizontal axis that is substantially parallel to a front face of the cooking apparatus 200 proximate its bottom edge. It will be appreciated that door hinge 250 may provide for other forms of movement of door 210, e.g., with some translation in addition to rotation, with one or more stops within the range of movement of the door, and/or with damping, biasing, counterbalancing, etc., functionality to provide for smooth and reliable movement of the door within its range of movement, as will be appreciated by those of ordinary skill having the benefit of the instant disclosure.

Door 210 may also include a door sensor 215 to detect a position and/or movement of the door 210. By doing so, a user could be alerted if, for example, an attempt was made to lock while the door was opened.

As noted above, the cooking apparatus 200 includes a control circuit 221 that is configured to operate a lock 280 in response to user input, at least in certain circumstances. The operation may be from an engaged state 281 to a disengaged state 282, or from a disengaged state 282 to an engaged state 281, in some embodiments. The control circuit's 221 operation of the lock 280 may trigger the control circuit 221 to subsequently generate an alert. When desired, the control circuit 221 may be programmed to turn the alert off. Additionally, when desired, the control circuit 221 may include a delay in the operation of the lock. This allows a temporal gap between the moment the control circuit 221 receives user input to operate the lock 280 and the moment the control circuit operates the lock 280, so that users may respond to any temporary interference. For example, in some instances, it may be desirable to include a delay after detecting user input to operate the lock 280, such that, for example, if the user accidently issued user input, or changed their mind about operation of the lock 280, the control circuit would not operate the lock.

With further reference to FIGS. 1 and 2, the lock 280 may be installed in a location on or inside the oven that is largely inaccessible (i.e. cannot be accessed when the door is closed) to the user. This lock 280 may be in an engaged state 281 (e.g., as shown in FIG. 2) or a disengaged state 282 (e.g., as shown in FIG. 1). When the lock 280 is in an engaged state 281, the door 210 will not be free to move. When the lock 280 is in a disengaged state 282, the door 210 will be free to move. The lock 280 may be magnetic, electrical, electro-mechanical, pneumatic, or any other suitable manner of securing the door 210 to preclude its movement away from a closed position, and generally includes an electronically-controlled actuator 284 capable of engaging or disengaging the lock in response to electronic control signals from the control circuit, e.g., received via connection 283.

The control circuit 221 may generate an audible and/or visual alert on user interface 220 in some embodiments, or may generate an audible and/or visual alert on a separate device 271, which may include, for example, a speaker, a light, a message that can cause a remote device to generate a sound or other audible, visible and/or haptic cue when received, etc. In response to determining user input indicating operation of the lock, the control circuit 221 may generate the alert. The control circuit 221 may also control aspects of the alert, such as the delay. In some embodiments, the control circuit 221 may generate the alert in part by communicating a message to a remote device 300 using one or more wired and/or wireless networks (e.g., represented at 304), and as such, may encode the alert with additional data so that the alert may be received and used by other devices 300. These other remote devices 300 may include an assistant device 301, mobile device 302, fire alarm 303, and any remote device capable of receiving the alert. The control circuit's 221 generation of the alert may be broadcast to a user and/or appear as a message presented on these other devices. The message may cause other devices 300 to generate a sound, a message, a visual notification in response to receiving the alert, and in some instances may cause a device to execute a function to perform various actions such as issuing a command to the cooking appliance to change its state.

Figure 3:
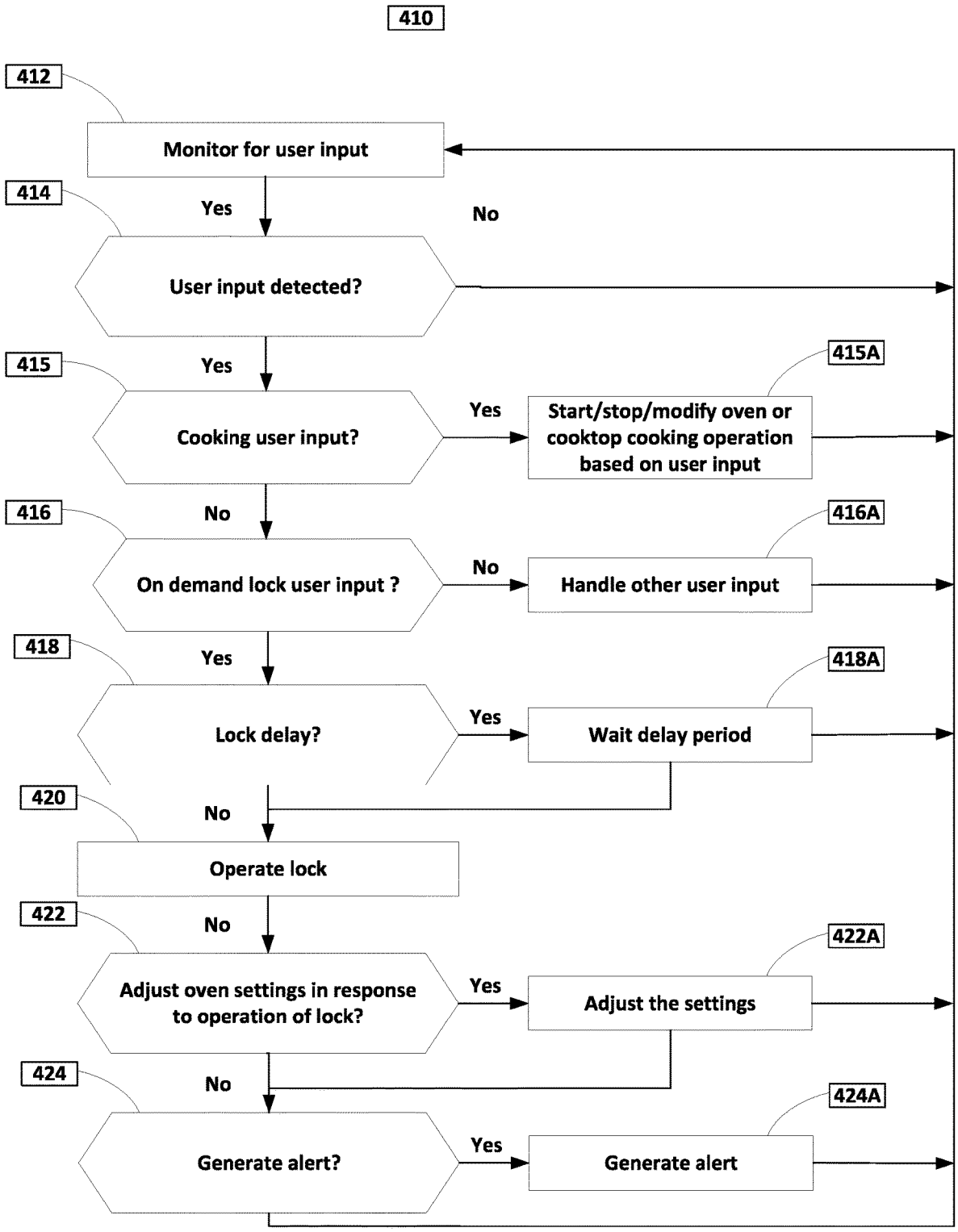
FIG. 3 is a flow chart of an example method of operating the cooking apparatus of FIGS. 1-2, according to one embodiment.

The flow chart of FIG. 3, along with FIGS. 1 and 2, illustrate an example method for operating the lock for some embodiments of the invention. It is assumed, in FIG. 3, that user input provided to the user interface indicating a user preference for the control circuit to operate the lock, will initiate the sequence of operations leading up to, including, and following, the operation of the lock. Thus, for example, it may be desirable in some embodiments to instruct a user to interact with the cooking apparatus in some manner (e.g., touching a dedicated button, touching two buttons simultaneously, touching a button for a preset amount of time, etc.) to initiate the operation of the lock. Moreover, it is assumed that monitoring for user input will be a continuous process throughout the method.

First, in block 412, a user interface monitors for user input. User input may include on demand lock user input and cooking user input, among other user input (such as setting a clock). The on demand lock user input may be used to engage or disengage the lock on demand, i.e., regardless of whether the oven is active. The cooking user input may be used to start, modify, or stop the cooking state of the oven. While the same controls of the user interface may be used by the user in inputting different types of input, invocation of one type of user input will not necessarily act as an invocation of another type of user input.

Next, in block 414, it is determined if user input is either detected or undetected. If user input is undetected, control passes to block 412 to continue to monitor. If user input is detected, control passes to block 415 to determine the type of user input, as block 414 does not make any determination as to the type of user input.

In block 415, it is determined if the user input that has been detected is cooking user input. If block 415 determines that cooking user input has been provided, then control passes to block 415A, where the control circuit may start, stop, or modify an oven or cooktop cooking operation as appropriate based on the specific user input provided.

If in block 415 it is determined that the user input is not cooking user input, control passes to block 416 to determine if the user input is on demand oven lock user input. If not, control passes to block 416A, as the user input is another type of user input that is not relevant to engaging or disengaging the on demand oven door lock, where the user input may be handled in a conventional manner. Other user input may include, but is not limited to, setting the clock, changing colors or illumination of the oven display, and all other input that is not cooking user input or on demand lock user input.

Returning to block 416, if it is determined that the user input is on demand lock user input, then control passes to block 418 to determine if a lock delay is being used. A delay may be useful for a variety of purposes, including averting operation of the lock when the when the user unintentionally provided user input, or allowing a user time to acknowledge a mistake and open the oven door before it is locked. If a lock delay is being used, then control passes to block 418A to determine the amount of time to wait for the delay and wait that amount of time prior to passing control to block 420 to operate the lock. In some embodiments, the delay may be fixed in the control circuit. In other embodiments, the delay may be configurable by the user. In some embodiments, no delay may be used, and block 418 and 418A may be omitted from the operation sequence. If a lock delay is not being used, block 418A is bypassed and control passes directly to block 420 to operate the lock.

Next, in block 422, the control circuit determines if settings are to be adjusted in response to the operation of the lock. The adjustment of settings in response to the operation of the lock may prevent the heating elements from continuing to generate heat if the lock operates and nobody is around to monitor the oven, reducing unnecessary power consumption and risk of fire hazard. In other embodiments, the adjustment of settings in response to locking may permit or promote the heating elements to generate heat if the lock operates, reducing the need for additional user input to adjust the oven settings after operating the locks. The adjustment of settings in response to operation of the lock may also trigger generation of an alert, notifying user of the change in oven settings, reducing the risk of fire hazard. Adjustment of the settings may be a result of an automatic response by the control circuit, or a manual response from a user or user assistant. If settings are to be adjusted, then control passes to block 422A to adjust the settings. The settings adjusted may include the operational state of the cooking apparatus, temperature, and any other adjustable feature of the oven, and any combination thereof.

After adjusting the settings in block 422A, or if block 422 determines that no command has been received, control passes to block 424 to determine whether an alert should be generated. The generation of the alert may be fixed in the control circuit or may be modified by the user. In some embodiments, no alert may be used. The alert may include at least one or more of audible, visual, communication output, and/or haptic output, and any other output, and any combination thereof.

As discussed previously, multiple embodiments of the cooking apparatus 200 and method of operating it 400 are possible. As but one example of an alternative embodiment, the cooktop 230 may be omitted and, instead of or in addition to, cooking elements 244 and 245, microwave technology may be used.

The disclosed cooking apparatus 200 may be a variety of constructions, shapes, sizes, quantities, and positions and still accomplish the same intent. The elements depicted in the figures may not be drawn to scale and thus, the elements may have different sizes and/or configurations other than as shown in the figures.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

What is claimed is:

1. A cooking apparatus, comprising:

a housing;

an oven cavity disposed within the housing;

one or more cooking elements configured to beat the oven cavity;

a door coupled to the housing, wherein the door is movable from a closed position to an open position to provide external access to the oven cavity;

an electronic lock configured to selectively lock the door in the closed position;

a user interface configured to receive user input; and a control circuit coupled to the electronic lock and the user interface, wherein the control circuit:

receives, from the user interface, first on demand lock user input to engage or disengage the electronic lock on demand while the oven is active;

selectively engages or disengages the electronic lock in response to the first on demand lock user input and while the oven is active;

receives, from the user interface, second on demand lock user input to engage or disengage the electronic lock on demand while the oven is inactive;

selectively engages or disengages the electronic lock in response to the second on demand lock user input and while the oven is inactive;

receives, from the user interface and while the electronic lock is engaged, cooking user input to start or stop an oven cooking operation; and starts or stops the oven cooking operation while the electronic lock is engaged in response to the cooking user input.

2. The cooking apparatus of claim 1, further comprising a cooktop, wherein the control circuit engages or disengages the electronic lock in response to the first and second on demand lock user input irrespective of whether the cooktop is currently active, wherein the cooking user input is first cooking user input, and wherein the control circuit starts and/or stops a cooktop cooking operation in response to second cooking user input while the electronic lock is engaged.

3. The cooking apparatus of claim 1, wherein an actuator of the electronic lock is inaccessible to the user.

4. The cooking apparatus of claim 1, wherein each of the first and second on demand lock user input includes simultaneous activation of multiple user controls of the user interface.

5. The cooking apparatus of claim 1, wherein each of the first and second on demand lock user input includes activation of a user control of the user interface for a preset amount of time.

6. The cooking apparatus of claim 1, wherein the control circuit further generates an alert after engaging or disengaging the electronic lock.

7. The cooking apparatus of claim 1, wherein the control circuit further modifies the oven cooking operation in response to the cooking user input received while the electronic lock is engaged.

8. The cooking apparatus of claim 7, wherein the cooking user input that modifies the oven cooking operation switches a cooking mode used for the oven cooking operation.

9. The cooking apparatus of claim 7, wherein the cooking user input that modifies the oven cooking operation increases or decreases a temperature setpoint.

10. The cooking apparatus of claim 1, wherein the control circuit starts, modifies, or stops a second oven cooking operation in response to the electronic lock engaging.

11. A method of operating a cooking apparatus of a type including a housing, an oven cavity disposed within the housing, one or more cooking elements configured to heat the oven cavity, a door coupled to the housing and movable from a closed position to an open position to provide external access to the oven cavity, an electronic lock configured to selectively lock the door in the closed position, a user interface configured to receive user input, and a control circuit, the method comprising:

receiving, from the user interface, first on demand lock user input to engage or disengage the electronic lock on demand while the oven is active;

selectively engaging or disengaging the electronic lock with the control circuit in response to the first on demand lock user input and while the oven is active;

receiving, from the user interface, second on demand lock user input to engage or disengage the electronic lock on demand while the oven is inactive;

selectively engaging or disengaging the electronic lock with the control circuit in response to the second on demand lock user input and while the oven is inactive;

receiving, from the user interface and while the electronic lock is engaged, cooking user input to start or stop an oven cooking operation; and starting of stopping the oven cooking operation with the control circuit while the electronic lock is engaged in response to the cooking user input.

12. The method of claim 11, further comprising:

determining, in response to receiving, from the user interface, the first on demand lock user input to engage or disengage the electronic lock on demand, whether the electronic lock has a delay, and in response to determining a delay exists, waiting the amount of time for the delay to expire before operating the electronic lock.

13. The method of claim 11, further comprising:

determining, in response to selectively engaging or disengaging the electronic lock with the control circuit in response to the first on demand lock user input, whether to adjust the oven settings, and in response to determining to adjust the oven settings, adjusting the oven settings.

14. The method of claim 11, further comprising:

determining, in response to selectively engaging or disengaging the electronic lock, whether an alert should be generated, and in response to determining that the alert should be generated, generating the alert.

15. The method of claim 11, wherein the first on demand lock user input is a simultaneous activation of multiple user controls of the user interface.

16. The method of claim 11, wherein the first on demand lock user input is an activation of a user control of the user interface for a preset amount of time.

17. The method of claim 11, further comprising:

modifying, in response to receiving second cooking user input to modify the oven cooking operation, the oven cooking operation while the electronic lock is engaged.

18. The method of claim 17, wherein the second cooking user input switches a cooking mode used for the oven cooking operation.

19. The method of claim 17, wherein the second cooking user input increases or decreases a temperature setpoint.

20. The method of claim 11, further comprising:

starting, modifying, or stopping, in response to selectively engaging or disengaging the electronic lock, a second oven cooking operation.

* * * * *